United States Patent [19]

Knowles

[11] 4,170,808

[45] Oct. 16, 1979

[54] BELT BUCKLE ASSEMBLY HAVING AN IMAGE FORMED ON A PHOTOSENSITIVE FACE PLATE THEREOF

[75] Inventor: Alfred E. Knowles, Raleigh, N.C.

[73] Assignee: Harlan J. Rath, Savanna, Ill.

[21] Appl. No.: 830,573

[22] Filed: Sep. 6, 1977

[51] Int. Cl.[2] ..... A44B 11/00

[52] U.S. Cl. ..... 24/163 K; 40/21 C; 96/86 R

[58] Field of Search ..... 24/163 K, 49 R, 163 R; 96/86 R, 86 P; 428/209, 203, 199; 40/21 C, 2.2, 1.5; 63/29 R

[56] References Cited

U.S. PATENT DOCUMENTS

| | | | |
|---|---|---|---|
| 916,236 | 3/1909 | West et al. | 96/86 R |
| 974,862 | 11/1910 | Dean | 63/29 R |
| 3,275,440 | 9/1966 | Kempe | 96/86 R |
| 3,290,232 | 12/1966 | Dunning | 428/199 |
| 4,052,773 | 10/1977 | Nesbitt | 24/163 K |

*Primary Examiner*—Kenneth J. Dorner
*Attorney, Agent, or Firm*—Mills & Coats

[57] ABSTRACT

The present invention relates to a belt buckle blank having an aluminum face plate that is anodized and which is photosensitive, and wherein additional properties and structural characteristics of said aluminum face plate is such that a negative photographic type image may be exposed to and developed on the aluminum face plate.

6 Claims, 6 Drawing Figures

BELT BUCKLE ASSEMBLY HAVING AN IMAGE FORMED ON A PHOTOSENSITIVE FACE PLATE THEREOF

The present invention relates to a belt buckle blank, and more particularly to belt buckle blanks having a face plate with a photographic image exposed thereon.

Over the past few years, belts and belt buckles have become a more emphasized and visible part of clothing and attire in general. In this regard, many belt buckle designs now are not totally functional per se, but are designed to include a variety of design features that make the buckle more attractive and interesting. For example, some belt buckles commercially available today include initials inscribed on the face of the buckle, and in some designs even one finds that these initials and other indicia are interchangeable. This allows an individual to influence the appearance of the belt buckle by changing the initials or indicia on the face of the buckle from time to time. In addition, country and western attire has long lent itself to ornamental and decorative belt buckle designs.

The present invention presents a belt buckle assembly having an aluminum face plate whose structural characteristics, properties, and general make up enable a photograph to be developed on an outer surface of the aluminum face plate. More particularly the aluminum face plate is anodized and is photosensitive such that the exposure of a negative photographic image to the aluminum face plate followed by proper developing procedures results in the photographic type image being printed or developed on the aluminum face plate. The resulting image and the outer surface of the aluminum face plate is protected and sealed by the provision of a sealing film about the outer surface of the aluminum face plate.

It is, therefore, an object of the present invention to provide a belt buckle blank with a metal photosensitive face that allows any type of photographic image to be developed on said face.

A further object of the present invention is to provide a belt buckle blank having an aluminum face plate that is both anodized and photosensitive for allowing photographic type images to be developed thereon.

Still a further object of the present invention is to provide a belt buckle blank with a photosensitive metal plate that is treated by a developing and fixing process such that an outer surface of said plate is generally a sapphire-hard, scatch resistant, and generally resist to deterioration due to chemicals and solvents.

It is also an object of the present invention to provide a belt buckle blank and photosensitive aluminum plate or face according to the present invention wherein the belt buckle blank is so designed that the photosensitive aluminum plate or face can be readily removed and another plate inserted therefor, whereby a series of different photographic type plates can be utilized with a single buckle blank.

Other objects and advantages of the present invention will become apparent from a study of the following description and the accompanying drawings which are merely illustrative of the present invention.

Figure 1:
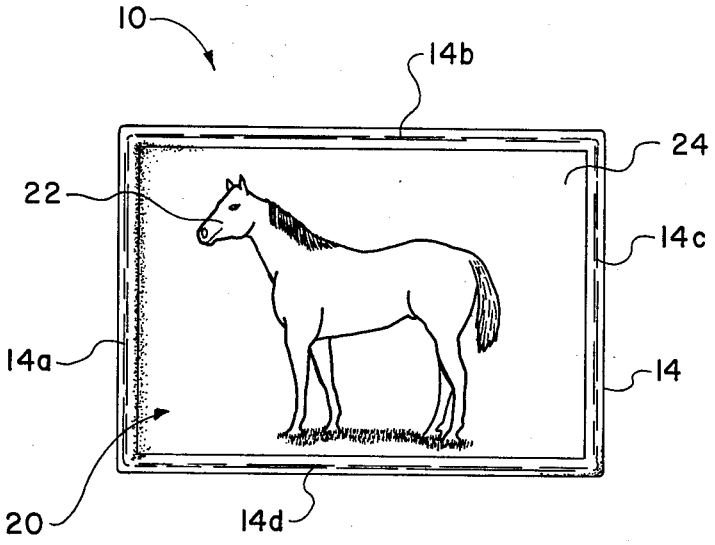
FIG. 1 is a front elevational view of the belt buckle assembly of the present invention, illustrating a photographic image developed on a face portion thereof.
Figure 2:
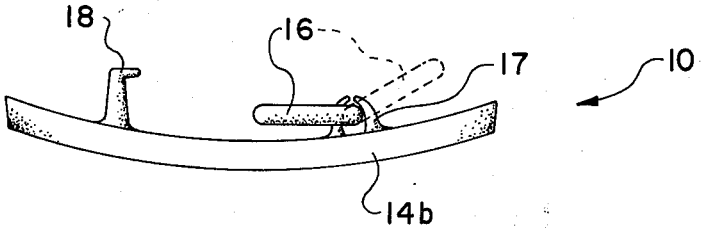
FIG. 2 is a top plan view of the belt buckle assembly.
Figure 3:
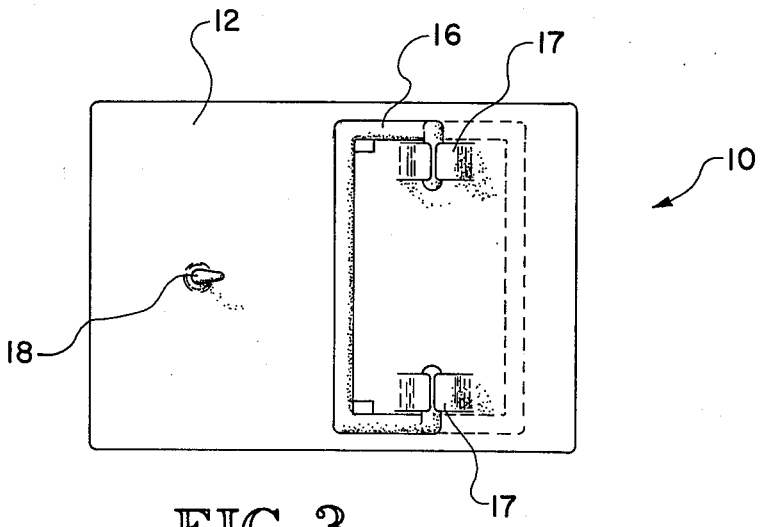
FIG. 3 is a rear elevational view of the belt buckle assembly of the present invention viewed oppositely of FIG. 1.

With further reference to the drawings, the belt buckle assembly of the present invention shown therein and illustrated generally by the numeral 10. Viewing the belt buckle assembly 10 in detail, it is seen that the same basically includes a buckle blank having a metal back 12 and an upstanding perimeter edge 14 which, as seen in FIG. 1, includes four edges—14*a*, 14*b*, 14*c* and 14*d*.

Secured about the back 12 of the buckle blank is a belt tie yoke 16 that is pivotably mounted within a pair of pivot collars 17. The tie yoke 16 is adapted to be connected in a conventional manner to a flexible belt (not shown). Also extending from back 12 of the buckle blank is a belt latching pin 18 that is adapted to be inserted in anyone of a plurality of openings formed in the belt so as to secure the combination belt buckle assembly and belt about the wearer.

Secured within the perimeter edge 14 of the buckle blank adjacent the back 12 is a metal face plate indicated generally by the numeral 20. In the present embodiment illustrated, the face plate 20 can be secured to back 12 by glue or other suitable securing means. In this specification, reference is made to a face plate, but it is to be understood that the face plate 20 could be in the form of a metal plate or metal film with the contemplated thickness of either being in the range of 0.002–0.200 inches.

Plate or film 20 is aluminum and is both anodized and is photosensitive. By having the photosensitive property, it follows that plate or film 20 is capable of having any type of photographic image developed thereon.

As seen in the drawings an image 22, of a standing horse, is shown on the outer surface of plate 20 and the area outside or exterior of the image 22 is referred to as the background area 24 of the plate and this can be a plain natural aluminum finish or it can be dyed by conventional means.

Figure 6:
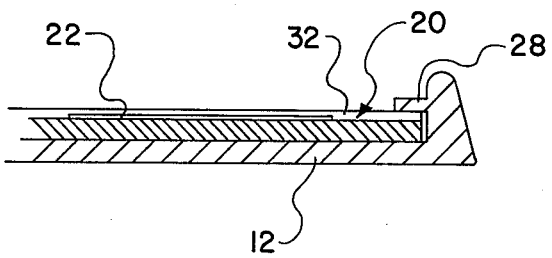
FIG. 6 is an enlarged cross sectional illustration of the basic belt buckle assembly of the present invention particularly illustrating various layers of the belt buckle assembly.

After the image 22, which can be of any photographic type, is exposed and developed on the plate 20, then a sealant film 32 (illustrated in Fig. 6) is placed over the outer surface of the plate 20 so as to cover the areas occupied by the image 22 as well as the background area 24. This assures that a generally sapphire-hard finish is produced that will protect the entire surface of the plate 20 and which will make the same scratch resistant, abrasion resistant, and water resistant. In addition due to the particular properties, physical characteristics, and general make up of the aluminum plate or film 20, the plate would also be resistant to harmful chemicals and solvents.

Figure 4:
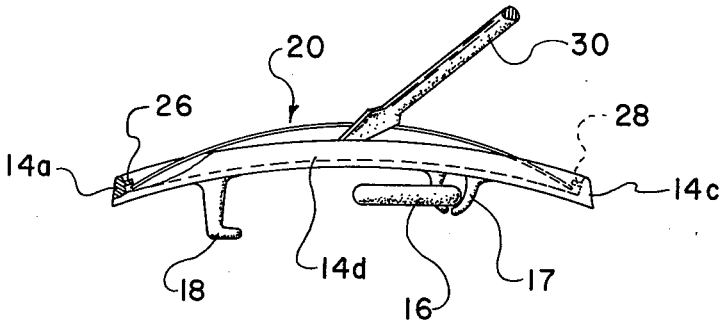
FIG. 4 is a top plan view of an alternate embodiment of the belt buckle assembly of the present invention, this alternate embodiment being adapted to include interchangeable face plates with the particular face plates being interchangeable as illustrated in this Figure.
Figure 5:
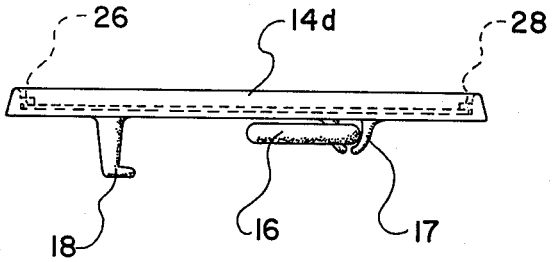
FIG. 5 is a top plan view of this alternate embodiment with a face plate in proper place.

With respect to FIGS. 4 and 5 and an alternate embodiment for the belt buckle assembly of the present invention, it is seen that in this belt buckle blank the same is provided with a pair of lips 26 and 28 that project inwardly from respective perimeter edges 14a and 14c. It is observed from FIG. 4 that each lip 26 and 28 is spaced just above the back 12 of the buckle blank so as to define a small opening thereunder that is adapted to receive an edge portion of a respective aluminum face plate or film 20.

As illustrated in FIG. 4, the presence of lips 26 and 28 allow the belt buckle assembly 10 to include a face plate or film interchangeable feature. In particularly, with the use of a tool such as a spade or screw driver, indicated by numeral 30 in FIG. 4, a plate film 20 can be gently pryed upwardly about the lid portion area such that the opposite edges underlying the lips 28 and 30 can be removed therefrom and consequently the entire plate or film can be removed from the belt buckle. Another plate or film 20 can be placed in the belt buckle assembly 10 by slightly bending or deflecting the buckle such that opposite outer edges can be placed underneath the lips 26 and 28. This, of course, allows the user of the belt buckle assembly 10 to change face plates or films 20 from time to time as he or she so desires.

At this point, the basic process for producing an image on the plate or film 20 should be generally discussed. In this regard, the basic steps of the process comprise exposing, developing, fixing, sealing, and polishing.

In producing a selective image 22 on the aluminum plate or film 20, the basic process entails exposing a negative image to the photosensitive aluminum plate or film 20. It is appreciated for best results that the photosensitive plates or film 20 be properly maintained prior to exposure. Basically the photosensitive plates should not be exposed to light prior to exposure. In addition, the photosensitive plates or films should not be exposed or processed in hot or cold environments, but should be kept in a temperature environment between 65 and 75 degrees Fahrenheit.

During exposure, a very rich light source should be used and the light intensity originating from the light source should be generally uniform over the entire surface area to be exposed.

To assure positive contact during the exposure stage and to generally prevent the development of a blurred or fuzzy image, a pressure plate or vacuum type frame should be used.

After exposure, then the aluminum plate or film 20 is ready for developing and fixing. The details of this step will not be dealt with herein in detail because the basic process of developing and fixing in photography and image transfer is known in the art.

As has already been discussed, in certain cases, it may be desirable to dye some areas of the plate or film such as the background area 16. In these cases, this dying step can be performed in conventional manner after developing and fixing.

After developing and fixing, and in some cases, it is preferable and advantageous to seal the outer exposed surface of the plate or film 20. This sealing step closes the pores of the anodized outer surface of the aluminum plate or film 20 and gives rise to a generally sapphire-hard surface. It is this sealed and hard surface that gives rise to the durability of this product. Sealing can be accomplished with the distilled water or other conventional types of sealing additives.

Once the outer surface of the aluminum plate or film 20 has been sealed, the outer surface of the plate or film is preferably polished. The polish can be of any conventional type that is utilized in finishing photography, but preferably may contain a light abrasive that will remove any residue about the surface of the plate or film 20. In addition, the polish should provide a lustrous finish to the outer surface of the plate.

From the foregoing specification, it is seen that the belt buckle of the present invention provides a novel and unique belt buckle assembly inasmuch as the same includes an aluminum face plate or film that is photosensitive in order that any type of photography image may be developed thereon. By using photographic images, it is appreciated that this allows a vast degree of variety in images and appearances for the belt buckle assembly. Additionally photographic images are easy and convenient to obtain and due often very personal and interesting in appearance. For example, it is possible to produce a team picture on the face or film 20 of the belt buckle assembly 10. This could be utilized by local community groups and various booster clubs to support local athletic events and teams, especially little league baseball, football and the like.

It is therefore, appreciated that the finished belt buckle assembly with a developed image on the aluminum face or film 20 presents a generally etched type process that is very smooth, clear, and hard and generally abrasive resistant. It is also important to emphasize that the images that finally appear on the aluminum face or film 20 are exact reproductions of actual photographs.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A belt buckle assembly having a photographic type image formed about a face portion thereof and comprising: a buckle blank having a back plate and connecting means for connecting said buckle blank to a flexible belt segment; an anodized photosensitive aluminum face secured to the back plate of said buckle blank; a photographic type image imprinted on said anodized photosensitive aluminum face; a sealed protective film layer disposed over said image and said aluminum face for providing a protective film about said image and said aluminum face; and wherein said buckle blank includes an upstanding perimeter edge and a pair of spaced apart face retaining means for retaining said aluminum face disposed within said buckle blank about opposite sides of said perimeter edge, each of said retaining means including a fixed and stationary projecting lip having an open area thereunder for receiving an edge portion of said aluminum face, whereby respective aluminum faces having different images developed thereon can be readily removed and inserted into said buckle blank.

2. The belt buckle assembly of claim 1 wherein said aluminum face includes an aluminum plate having a thickness of at least 0.002 inches but less than 0.200 inches.

3. The belt buckle assembly of claim 2 wherein said photographic type image developed on said aluminum face actually pentrates and lies within said aluminum face.

4. The belt buckle assembly of claim 3 wherein said sealant layer actually closes pores formed in an upper surface area of said aluminum face.

5. The belt buckle assembly of claim 4 wherein said aluminum face includes a dyed face surface.

6. A belt buckle assembly having a photographic type pictorial image formed about the face portion thereof and comprising: a buckle blank having a back plate and connecting means for connecting said buckle blank to a flexible belt segment; an anodized photosensitive dyed aluminum face secured to the back plate of said buckle blank with said aluminum face including an aluminum plate having a thickness of at least 0.002 inches but less than 0.200 inches; a photographic type pictorial image imprinted on said anodized photosensitive aluminum face that actually penetrates and lies within said aluminum face; a sealed protective film layer disposed over said image and said aluminum face for providing a protective film about said image and said aluminum face by actually closing pores formed in an upper surface area of said aluminum face; and wherein said buckle plate includes an upstanding perimeter edge disposed about the back plate thereof and retaining means disposed about opposite side portions of said upstanding perimeter edge, said retaining means including a pair of opposed projecting lips having an open area thereunder for receiving an edge portion of said aluminum face, whereby respective aluminum faces having different pictorial images developed thereon can be readily removed and inserted into said buckle blank.

* * * * *